US007588429B2

(12) United States Patent
Hosono

(10) Patent No.: US 7,588,429 B2
(45) **Date of Patent: *Sep. 15, 2009**

(54) OIL PUMP ROTOR ASSEMBLY

(75) Inventor: Katsuaki Hosono, Niigata (JP)

(73) Assignee: Mitsubishi Materials PMG Corporation, Nigata (JP)

( * ) Notice: Subject to any disclaimer, the term of this patent is extended or adjusted under 35 U.S.C. 154(b) by 270 days.

This patent is subject to a terminal disclaimer.

(21) Appl. No.: 10/556,744

(22) PCT Filed: Aug. 25, 2004

(86) PCT No.: PCT/JP2004/012170

§ 371 (c)(1),
(2), (4) Date: Aug. 9, 2006

(87) PCT Pub. No.: WO2005/021969

PCT Pub. Date: Mar. 10, 2005

(65) Prior Publication Data

US 2007/0065327 A1 Mar. 22, 2007

(30) Foreign Application Priority Data

Sep. 1, 2003 (JP) ..... 2003-309348

(51) Int. Cl.
*F04C 2/00* (2006.01)
*F03C 2/00* (2006.01)

(52) U.S. Cl. ..... 418/150; 418/171

(58) Field of Classification Search ..... 418/150, 418/166, 171, 189, 190
See application file for complete search history.

(56) References Cited

U.S. PATENT DOCUMENTS

| | | | |
|---|---|---|---|
| 5,368,455 | A | 11/1994 | Eisenmann |
| 6,077,059 | A | 6/2000 | Hosono |
| 6,887,056 | B2 | 5/2005 | Hosono |

FOREIGN PATENT DOCUMENTS

| | | | |
|---|---|---|---|
| JP | 2-95787 | A | 4/1990 |
| JP | 5-256268 | A | 10/1993 |
| JP | 11-264381 | A | 9/1999 |
| JP | 2003-322088 | A | 11/2003 |

OTHER PUBLICATIONS

International Search Report for PCT/JP2004/012170 completed Jan. 27, 2005.
Patent Abstracts of Japan for JP2003-322088 published Nov. 14, 2003.
Patent Abstracts of Japan for JP11-264381 published Sep. 28, 1999.
Patent Abstracts of Japan for JP2-95787 published Apr. 6, 1990.
Patent Abstracts of Japan for JP5-256268 published Oct. 5, 1993.

*Primary Examiner*—Theresa Trieu
(74) *Attorney, Agent, or Firm*—Darby & Darby P.C.

(57) ABSTRACT

An oil pump rotor assembly is disclosed. An inner rotor formed with n external teeth is based on cycloid curves which are generated by a first circumscribed-rolling circle and a first inscribed-rolling circle by rolling the first circumscribed-rolling circle and first inscribed-rolling circle along an inner base circle. An outer rotor formed with n+1 internal teeth (n+1 is the number of teeth) is based on cycloid curves which are generated by a second circumscribed-rolling circle and a second inscribed-rolling circle by rolling the second circumscribed-rolling circle and second inscribed-rolling circles along an outer base circle.

8 Claims, 7 Drawing Sheets

PRIOR ART

PRIOR ART

PRIOR ART

OIL PUMP ROTOR ASSEMBLY

CROSS-REFERENCE TO PRIOR APPLICATION

This is a U.S. national phase application under 35 U.S.C. §371 of International Patent Application No. PCT/JP2004/012170 filed Aug. 25, 2004 and claims the benefit of Japanese Patent Application No. 2003-309348 filed Sep. 1, 2003, both of which are incorporated by reference herein. The International Application was published in Japanese on Mar. 10, 2005 as WO 2004/021969 A1 under PCT Article 21(2).

TECHNICAL FIELD

This invention relates to an oil pump rotor assembly used in an oil pump which draws and discharges fluid by volume change of cells formed between an inner rotor and an outer rotor.

BACKGROUND ART

A conventional oil pump comprises an inner rotor formed with "n" external teeth ("n" is a natural number), an outer rotor formed with "n+1" internal teeth which are engageable with the external teeth, and a casing in which a suction port for drawing fluid and a discharge port for discharging fluid are formed. The inner rotor is rotated to rotate the outer rotor by the engagement of the external teeth with the internal teeth, so that fluid is drawn and is discharged by changes in the volumes of plural cells formed between the inner and outer rotors.

Each of the cells is delimited at a front portion and at a rear portion as viewed in the direction of rotation of the inner rotor and outer rotor by contact between the external teeth of the inner rotor and the internal teeth of the outer rotor, and is also delimited at either side portions by the casing, so that an independent fluid conveying chamber is formed. While the external teeth and the internal teeth engage with each other, the cell becomes the smallest in volume. Then, when the cell moves along the inlet port, it increases in volume to draw fluid, and thereby it has the largest volume. Then, when the cell moves along the discharge port, it decreases in volume to discharge fluid.

Since such oil pumps having the above construction are compact and simply constructed, it is widely used as pumps for lubrication oil in automobiles and as oil pumps for automatic transmissions, etc. When an oil pump is mounted on an automobile, means for driving the oil pump includes a crankshaft directly-connected and driven method in which an inner rotor is directly connected to a crankshaft of an engine and the inner rotor is driven by the rotation of the engine.

With regard to the oil pump as described above, in order to reduce noise emitted from an oil pump and to improve mechanical efficiency accompanied therewith, an appropriate size of clearance is set between a tooth tip of the inner rotor and a tooth tip of the outer rotor in a rotational phase advancing by 180° from a rotational phase in which the inner and outer rotors engage with each other in their combined state.

Meanwhile, the conditions that are required to determine the tooth profile of an inner rotor ri and the tooth profile of an outer rotor ro will be described. First, with regard to the inner rotor ri, the rolling distance of a first circumscribed-rolling circle Di' (the diameter thereof is ϕDi') and the rolling distance of a first inscribed-rolling circle di' (the diameter thereof is ϕdi') must be completed in one cycle. That is, since the rolling distance of the first circumscribed-rolling circle Di' and the rolling distance of the first inscribed-rolling circle di' must be equal to the length of circumference of a base circle bi' (the diameter thereof is ϕbi') of the inner rotor ri, the following equation is satisfied:

$$\phi bi'=n\cdot(\phi Di'+\phi di')$$

Similarly, with regard to the outer rotor ro, since the rolling distance of a second circumscribed-rolling circle Do' (the diameter thereof is ϕDo') and the rolling distance of a second inscribed-rolling circle do' (the diameter thereof is ϕdo') must be equal to the length of circumference of a base circle bo' (the diameter thereof is ϕbo') of the outer rotor ro, $$\phi bo'=(n+1)\cdot(\phi Do'+\phi do')$$

Next, since the inner rotor ri engages with the outer rotor ro, the eccentric distance e' between the inner and outer rotors ri and ro satisfies the following equations:

$$\phi Di'+\phi di'=\phi Do'+\phi do'=2e$$

Based on the respective equations, the following equation is obtained:

$$n\cdot\phi bo'=(n+1)\cdot\phi bi'$$

The tooth profile of the inner rotor ri and the tooth profile of the outer rotor ro are constructed to satisfy the above conditions.

Here, in order to divide the clearance t into a tip clearance between a tooth space and a tooth tip in a rotational phase in which the inner and outer rotors engage with each other, and a tip clearance between tooth tips in a rotational phase advanced by 180° from the rotational phase in which the inner and outer rotors engage with each other, the circumscribed-rolling circle and the inscribed-rolling circle are respectively constructed to satisfy the following equations:

$$\phi Do'=\phi Di'+t/2, \text{ and}$$

$$\phi do'=\phi di'-t/2$$

That is, the circumscribed-rolling circle of the outer rotor is made larger than that of the inner rotor (ϕDo'>ϕDi). As a result, as shown in FIG. 6, a clearance 2/t is formed between a tooth space of the outer rotor ro and a tooth tip of the inner rotor ri in the rotational phase in which the inner and outer rotors engage with each other. On the other hand, the inscribed-rolling circle of the inner rotor is made larger than that of outer rotor (ϕdi'>ϕdo'). As a result, as shown in FIG. 7, a clearance t/2 is formed between a tooth tip of the outer rotor ro and a tooth space of the inner rotor ri in a rotational phase in which the inner and outer rotors engage with each other (For example, see Patent Document 1). Moreover, as shown in FIGS. 6 and 7, not only a tip clearance tt is formed between tip portions of the external and internal teeth of the inner and outer rotors, but also a side clearance ts is formed between the tooth surfaces of the external and internal teeth of the inner and outer rotors.

An oil pump rotor assembly constructed to satisfy the above relations is shown FIGS. 5 to 7. In the inner rotor ri, ϕbi'=52.00 mm; ϕDi'=2.50 mm; and ϕdi'=2.70 mm; and n=10, where ϕbi' is the diameter of the base circle bi', ϕDi' is the diameter of the first circumscribed-rolling circle Di', ϕdi' is the diameter of the first inscribed-rolling circle di', and n is the number of the external teeth, and in the outer rotor ro, ϕ=70 mm; ϕbo'=57.20 mm; ϕDo'=2.56 mm; ϕdo'=2.64 mm; n+1=11; and e'=2.6 mm, where ϕ is the external diameter of the outer rotor, ϕbo' is the diameter of the base circle bo', ϕDo' is the diameter of the second circumscribed-rolling circle Do', and ϕdo' is the diameter of the second inscribed-rolling circle do', n+1 is the number of the internal teeth, and n+1 is the eccentric distance.

In the oil pump rotor assembly have the above construction, the inner and outer rotors are formed such that the profile of a tooth tip of the inner rotor is smaller than the profile of a tooth space of the outer rotor and the profile of a tooth space of the inner rotor is larger than the profile of a tooth tip of the outer rotor. Thus, the backlash is set to an appropriate size and the tip clearance tt is set to an appropriate size. As a result, a large backlash can be surely obtained while the tip clearance tt is kept small. Thus, in particular, in a state where the pressure of oil supplied to the oil pump rotor assembly and the torque that drives the oil pump rotor assembly are stable, noise caused by collision between the external teeth of the inner rotor and the internal teeth of the outer rotor can be prevented from being generated.

[Patent Document 1]

Japanese Unexamined Patent Application Publication No. 11-264381

DISCLOSURE OF THE INVENTION

However, when the diameter of the second circumscribed-rolling circle Do' and the diameter of the second inscribed-rolling circle do' are adjusted to obtain the tip clearance tt=2/t, as shown in FIGS. 6 and 7, the side clearance ts may become large inevitably. Accordingly, with regard to the silence property of the oil pump rotor assembly, the following problems are left unsolved. That is, in a case that the hydraulic pressure generated in the oil pump rotor assembly is extremely small, and the torque that drives the oil pump rotor assembly changes, the internal teeth of the outer rotor and the external teeth of the inner rotor collide with each other. The collision energy at this time is transformed into sound. The sound may reach the level of audible sound, which is turned into noise.

The present invention has been made in consideration of the above circumstances. It is therefore an object of the present invention to appropriately set the tooth profile of an inner rotor and the tooth profile of an outer rotor, and appropriately set clearances between the inner and outer rotors, so that, even when the hydraulic pressure generated in the oil pump rotor assembly is extremely small and the torque that drives the oil pump rotor assembly changes, noise can be surely prevented from being generated.

In order to solve the above problems and accomplish the above object, the present invention proposes the following means.

According to the first aspect of the present invention, there is provided an oil pump rotor assembly comprising: an inner rotor formed with "n" external teeth ("n" is a natural number); and an outer rotor formed with (n+1) internal teeth which are engageable with the external teeth, and a casing having a suction port for drawing fluid and a discharge port for discharging fluid, wherein the fluid is conveyed by drawing and discharging the fluid by volume change of cells formed between tooth surfaces of the inner and outer rotors during relative rotation between the inner and outer rotors engaging each other. Each of the tooth profiles of the inner rotor is formed such that the profile of a tooth tip thereof is formed using an epicycloid curve which is generated by rolling a first circumscribed-rolling circle Di along a base circle bi without slippage, and the profile of a tooth space thereof is formed using a hypocycloid curve which is generated by rolling an inscribed-rolling circle di along the base circle bi without slippage. Each of the tooth profiles of the outer rotor is formed such that the profile of a tooth space thereof is formed using an epicycloid curve which is generated by rolling a second circumscribed-rolling circle Do along a base circle bo without slippage, and the profile of a tooth tip thereof is formed using a hypocycloid curve which is generated by rolling a second inscribed-rolling circle do along the base circle bo without slippage. The inner and outer rotors are constructed to satisfy the following relations:

$$\phi bi = n\cdot(\phi Di + \phi di),$$

$$\phi bo = (n+1)\cdot(\phi Do + \phi do),$$

$$\phi Di + \phi di = 2e, \text{ or } \phi Do + \phi do = 2e$$

$$\phi Do > \phi Di,$$

$$\phi di > \phi do, \text{ and}$$

$$(\phi Di + \phi di) < (\phi Do + \phi do),$$

where ϕbi is the diameter of the base circle bi of the inner rotor, ϕDi is the diameter of the first circumscribed-rolling circle Di of the inner rotor, ϕdi is the diameter of the first inscribed-rolling circle di of the inner rotor, ϕbo is the diameter of the base circle bo of the outer rotor, ϕDo is the diameter of the second circumscribed-rolling circle Do of the outer rotor, ϕdo is the diameter of the second inscribed-rolling circle do of the outer rotor, and e is the eccentric distance between the inner and outer rotors.

That is, in order to determine the tooth profiles of the inner and outer rotors, first, since the rolling distance of the circumscribed-rolling circle of the inner rotor and the rolling distance of the inscribed-rolling circle of the outer rotor must be completed in one cycle, the following equations are satisfied:

$$\phi bi = n\cdot(\phi Di + \phi di), \text{ and}$$

$$\phi bo = (n+1)\cdot(\phi Do + \phi do)$$

In order to obtain a large backlash between the tooth surfaces of the inner and outer rotors while they engages with each other, the profile of a tooth tip of the inner rotor formed by the first circumscribed-rolling circle Di with respect to the profile of a tooth space of the outer rotor formed by the second circumscribed-rolling circle Do and the profile of a tooth tip of the outer rotor formed by the second inscribed-rolling circle do with respect to the profile of a tooth space of the inner rotor formed by the first inscribed-rolling circle di must satisfy the following inequalities:

$$\phi Do > \phi Di, \text{ and}$$

$$\phi di > \phi do$$

Here, the backlash means a clearance that may be created between the tooth surface of the outer rotor and the tooth surface of the inner rotor opposite to the tooth surface thereof to which load is applied when the inner and outer rotors engage with each other.

Further, since the inner rotor engages with the outer rotor, any one of the following equations must be satisfied:

$$\phi Di + \phi di = 2e, \text{ and}$$

$$\phi Do + \phi do = 2e$$

Moreover, in the present invention, in order to rotate the inner rotor inside the outer rotor well, to adequately maintain the size of backlash while the tip clearance is surely obtained, and to reduce the engaging resistance, the diameter of the base circle of the outer rotor is made large compared with the conventional oil pump rotor assembly such that the base circle of the inner rotor does not comes in contact with the base circle of the outer rotor in a rotational phase in which the inner and outer rotors engage with each other. That is, the following inequality is satisfied:

$$(n+1)\cdot\phi bi<n\cdot\phi bo$$

As a result, the following inequality is derived:

$$(\phi Di+\phi di)<(\phi Do+\phi do)$$

According to this invention, the side clearance between the tooth surfaces of the inner and outer rotors is made small compared with the conventional oil pump rotor assembly while the tip clearance between the external teeth of the inner rotor and the internal teeth of the outer rotor is surely obtained. Thus, it is possible to realize an oil pump rotor assembly with a small play between the inner and outer rotors and an excellent silence property. Particularly, even if the hydraulic pressure generated in the oil pump rotor assembly is extremely small, and the torque that drives the oil pump rotor assembly changes, the internal teeth of the outer rotor can be prevented from colliding with the external teeth of the inner rotor. Thus, the silence property of the oil pump rotor assembly can be surely improved.

According to a second aspect of the present invention, there is provided the oil pump rotor assembly according to the first aspect in which the inner and outer rotors are constructed to satisfy the following inequality:

$$0.005\text{ mm}\leqq(\phi Do+\phi do)-(\phi Di+\phi di)\leqq 0.070\text{ mm (mm: millimeters)}$$

According to this invention, the inner and outer rotors are constructed to satisfy the following inequality:

$$0.005\text{ mm}\leqq(\phi\mathrm{Do}+\phi\mathrm{do})-(\phi Di+\phi di)$$

As a result, the size of backlash can be adequately maintained while the tip clearance can be surely obtained, and noise due to the engagement between the inner and outer rotors can be reduced. Further, the inner and outer rotors are constructed to satisfy the following inequality:

$$(\phi Do+\phi do)-(\phi Di+\phi di)\leqq 0.070\text{ mm}$$

As a result, the mechanical efficiency can be prevented from being reduced and noise can be prevented from being generated.

According to the oil pump rotor related to the present invention, clearances between the external teeth of the inner rotor and the internal teeth of the outer rotor are surely obtained and the side clearance between tooth surfaces of the inner and outer rotors is made small compared with the conventional oil pump rotor assembly. Thus, it is possible to realize an oil pump rotor assembly with a small play between the inner and outer rotors and an excellent silence property. Particularly, even when the hydraulic pressure generated in the oil pump rotor assembly is extremely small and the torque that drives the oil pump rotor assembly changes, noise can be surely prevented from being generated.

$$\phi bi=n\cdot(\phi Di+\phi di),$$

$$\phi bo=(n+1)\cdot(\phi Do+\phi do)$$

Figure 5:
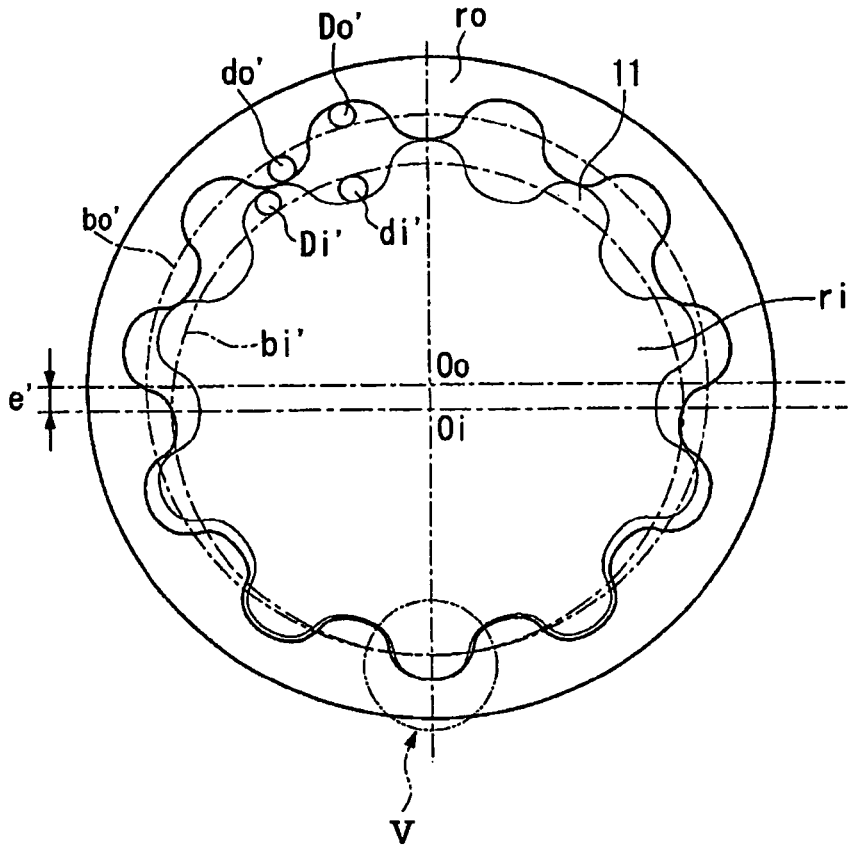
FIG. 5 is a plan view illustrating the conventional oil pump in which inner and outer rotors are constructed to satisfy the following relations.
Figure 6:
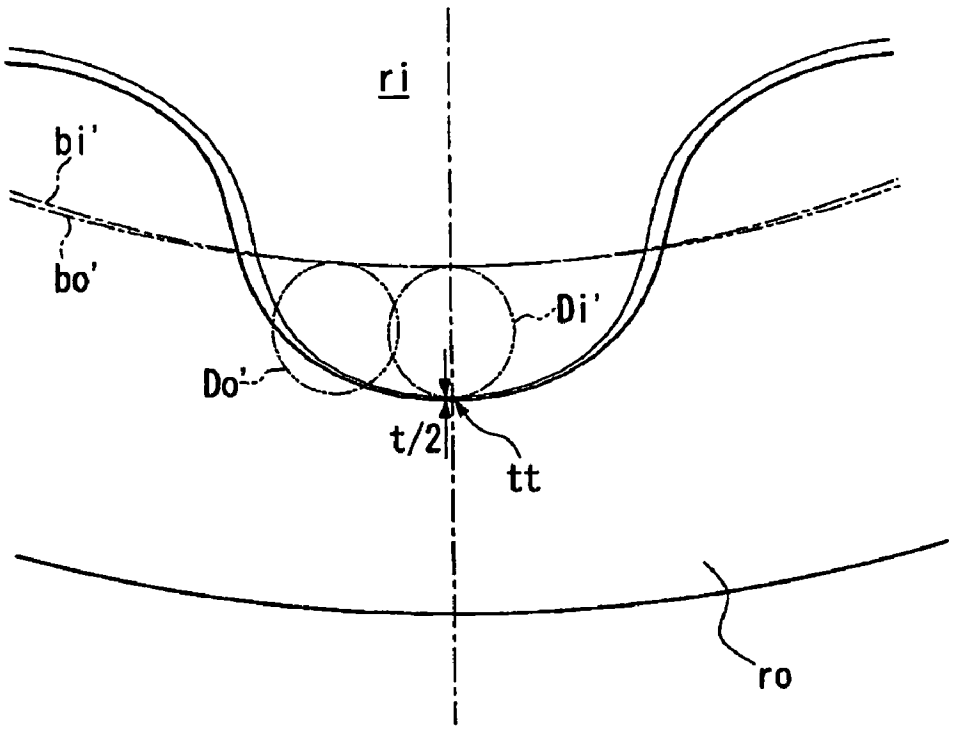
Figure 7:
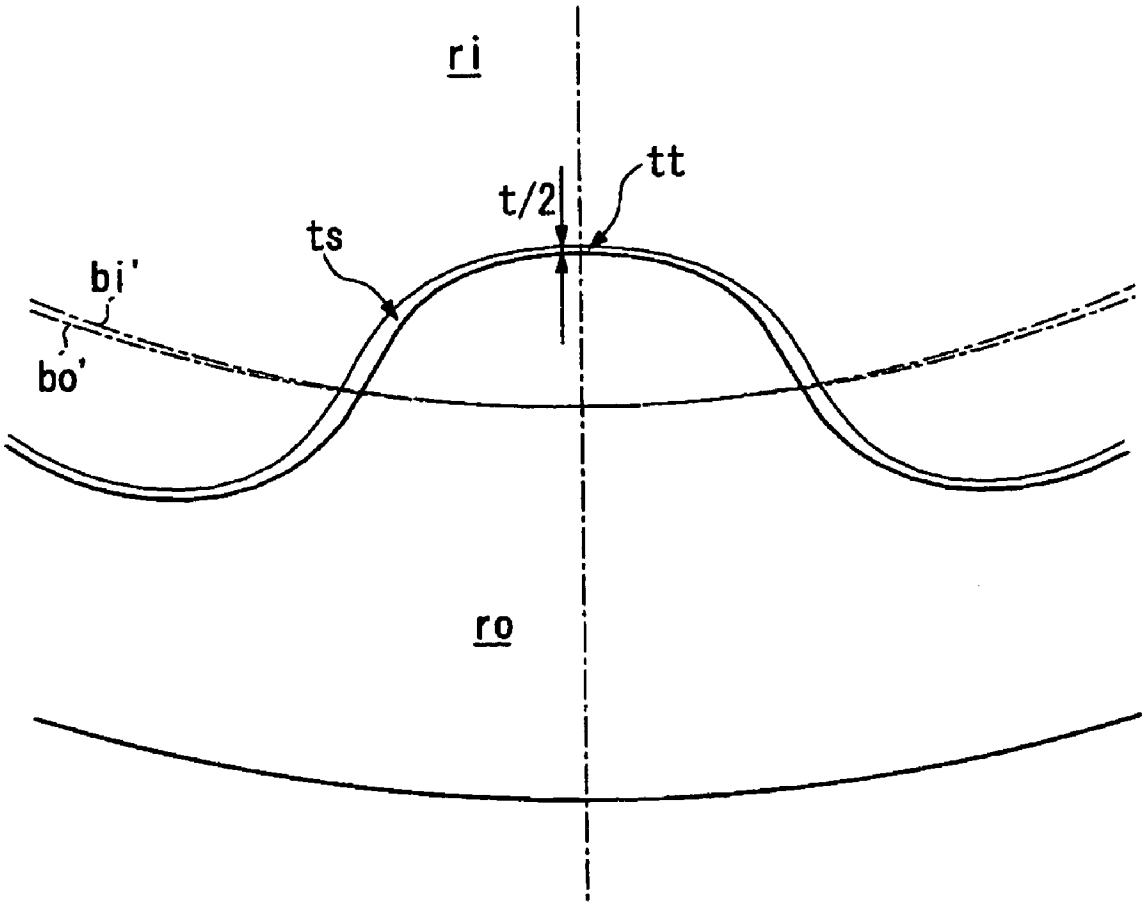

$$\phi Di+\phi di=2e,\text{ or }\phi Do+\phi do=2e$$

$$\phi\mathrm{Do}>\phi\mathrm{Di},\text{ and}$$

$$\phi\mathrm{di}>\phi\mathrm{do}$$

and $(\phi\mathrm{Do}+\phi\mathrm{do})-(\phi\mathrm{Di}+\phi\mathrm{di})$ is set to 0.009 mm;

FIG. 6 is an enlarged view taken along the line V, which illustrates engaging portions of the oil pump shown in FIG. 5; and FIG. 7 is an enlarged view illustrating the engaging portions of the oil pump shown in FIG. 5 in a state where a tooth tip of the outer rotor and a tooth space of the inner rotor engages with each other.

REFERENCE NUMERALS

10 inner rotor
11 external teeth
20 outer rotor
21 internal teeth
50 casing
Di circumscribed-rolling circle of inner rotor (first circumscribed-rolling circle)
Do circumscribed-rolling circle of outer rotor (second circumscribed-rolling circle)
di inscribed-rolling circle of inner rotor (first inscribed-rolling circle)
do inscribed-rolling circle of outer rotor (second inscribed-rolling circle)
C cell
bi base circle of inner rotor
bo base circle of outer rotor
Oi axis of inner rotor
Oo axis of outer rotor

BEST MODE FOR CARRYING OUT THE INVENTION

One embodiment of an oil pump rotor assembly according to the present invention will now be described with reference to FIGS. 1 through 4.

Figure 1:
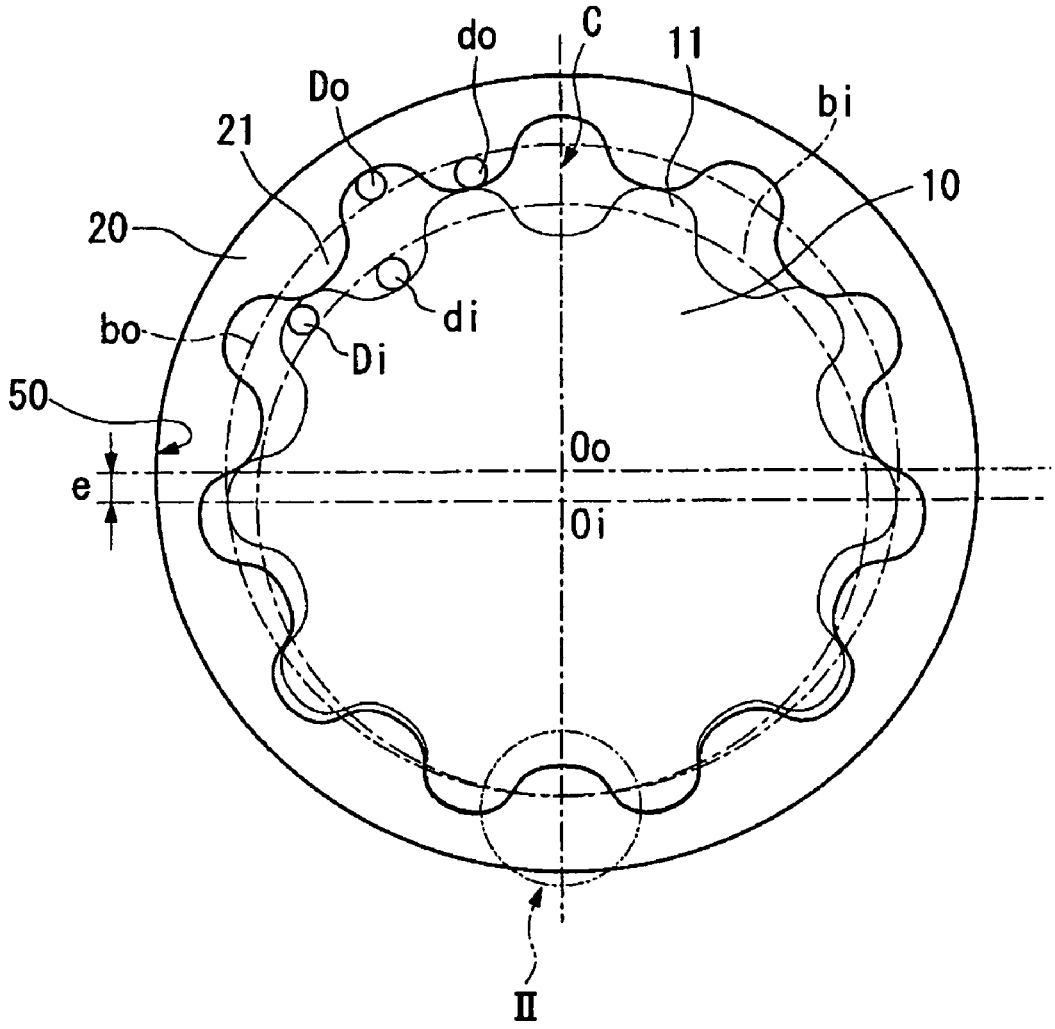
FIG. 1 is a plan view illustrating an oil pump according to one embodiment of the present invention.

The oil pump shown in FIG. 1 comprises an inner rotor 10 formed with "n" external teeth ("n" is a natural number, and n=10 in this embodiment), an outer rotor 20 formed with "n+1" internal teeth (n+1=11 in this embodiment) which are engageable with the external teeth, and a casing 50 which accommodates the inner rotor 10 and the outer rotor 20.

Between the tooth surfaces of the inner and outer rotors 10 and 20, there are formed plural cells C in the direction of rotation of the inner and outer rotors 10 and 20. Each of the cells C is delimited at a front portion and at a rear portion as viewed in the direction of rotation of the inner and outer rotors 10 and 20 by contact between the external teeth 11 of the inner rotor 10 and the internal teeth 21 of the outer rotor 20, and is also delimited at either side portions by the casing 50, so that an independent fluid conveying chamber is formed. Each of the cells C moves while the inner and outer rotors 10 and 20 rotate, and the volume of each of the cells C cyclically increases and decreases so as to complete one cycle in a rotation.

The inner rotor 10 is mounted on a rotational axis so as to be rotatable about the axis Oi. The profile of a tooth tip of the inner rotor 10 is formed using an epicycloid curve, which is generated by rolling a first circumscribed-rolling circle Di along the base circle bi of the inner rotor 10 without slippage, and the profile of a tooth space of the inner rotor 10 is formed using a hypocycloid curve, which is generated by rolling a first inscribed-rolling circle di along the base circle bi without slippage.

The outer rotor 20 is supported so as to be rotatable about the axis Oo in the casing 50, and the axis Oo thereof is positioned so as to have an offset (the eccentric distance is "e") from the axis Oi of the inner rotor 10. The profile of a tooth space of the outer rotor 20 is formed using an epicycloid curve which is generated by rolling a second circumscribed-rolling circle Do along a base circle bo without slippage, and the profile of a tooth tip thereof is formed using a hypocycloid curve which is generated by rolling a second inscribed-rolling circle do along the base circle bo without slippage.

When ϕbi is the diameter of the base circle bi of the inner rotor 10, ϕDi is the diameter of the first circumscribed-rolling circle Di thereof, ϕdi is the diameter of the first inscribed-rolling circle di thereof, ϕbo is the diameter of the base circle bo of the outer rotor 20, ϕDo is the diameter of the second circumscribed-rolling circle Do thereof, and ϕdo is the diameter of the second inscribed-rolling circle do thereof, the following relations are to be satisfied between the inner and outer rotors 10 and 20. Note that dimensions will be expressed in millimeters.

First, with regard to the inner rotor 10, the rolling distance of the first circumscribed-rolling circle Di and the rolling distance of the first inscribed-rolling circle di must be completed in one cycle. That is, since the rolling distance of the first circumscribed-rolling circle Di and the rolling distance of the first inscribed-rolling circle di must be equal to the length of circumference of the base circle bi, $$\cdot\phi bi = n\cdot\cdot(\phi Di+\phi di), \text{ i.e.,}$$

$$\phi bi = n\cdot(\phi Di+\phi di) \quad \text{(Ia)}$$

Similarly, with regard to the outer rotor 20, since the rolling distance of the second circumscribed-rolling circle Do and the rolling distance of the second inscribed-rolling circle do must be equal to the length of circumference of the base circle bo, $$\cdot\phi bo = (n+1)\cdot\cdot(\phi Do+\phi do), \text{ i.e.,}$$

$$\phi bo = (n+1)\cdot(\phi Do+\phi do) \quad \text{(Ib)}$$

In order to obtain a large backlash between the tooth surfaces of the inner and outer rotors while they engage with each other, the profile of a tooth tip of the inner rotor formed by the first circumscribed-rolling circle Di with respect to the profile of a tooth space of the outer rotor formed by the second circumscribed-rolling circle Do and the profile of a tooth tip of the outer rotor formed by the second inscribed-rolling circle do with respect to the profile of a tooth space of the inner rotor formed by the first inscribed-rolling circle di must satisfy the following inequalities:

$$\phi Do > \phi Di, \text{ and}$$

$$\phi di > \phi do$$

Here, the backlash means a clearance that may be created between the tooth surface of the outer rotor and the tooth surface of the inner rotor opposite to the tooth surface thereof to which load is applied while the inner and outer rotors engage with each other.

Further, since the inner rotor engages with the outer rotor, any one of the following equations must be satisfied:

$$\phi Di+\phi di = 2e, \text{ and}$$

$$\phi Do+\phi do = 2e$$

Moreover, in the present invention, in order to rotate the inner rotor 10 inside the outer rotor 20 well, to adequately maintain the size of backlash while the tip clearance is surely obtained, and to reduce the engaging resistance, the diameter of the base circle bo of the outer rotor 20 is made large such that the base circle bi of the inner rotor 10 does not comes in contact with the base circle bo of the outer rotor 20 in a rotational phase in which the inner and outer rotors 10 and 20 engages with each other. That is, the following inequality is satisfied:

$$(n+1)\cdot\phi bi < n\cdot\phi bo$$

Based on the above inequality and the equations (Ia) and (Ib), the following inequality is obtained:

$$(\phi Di+\phi di) < (\phi Do+\phi do)$$

Figure 2:
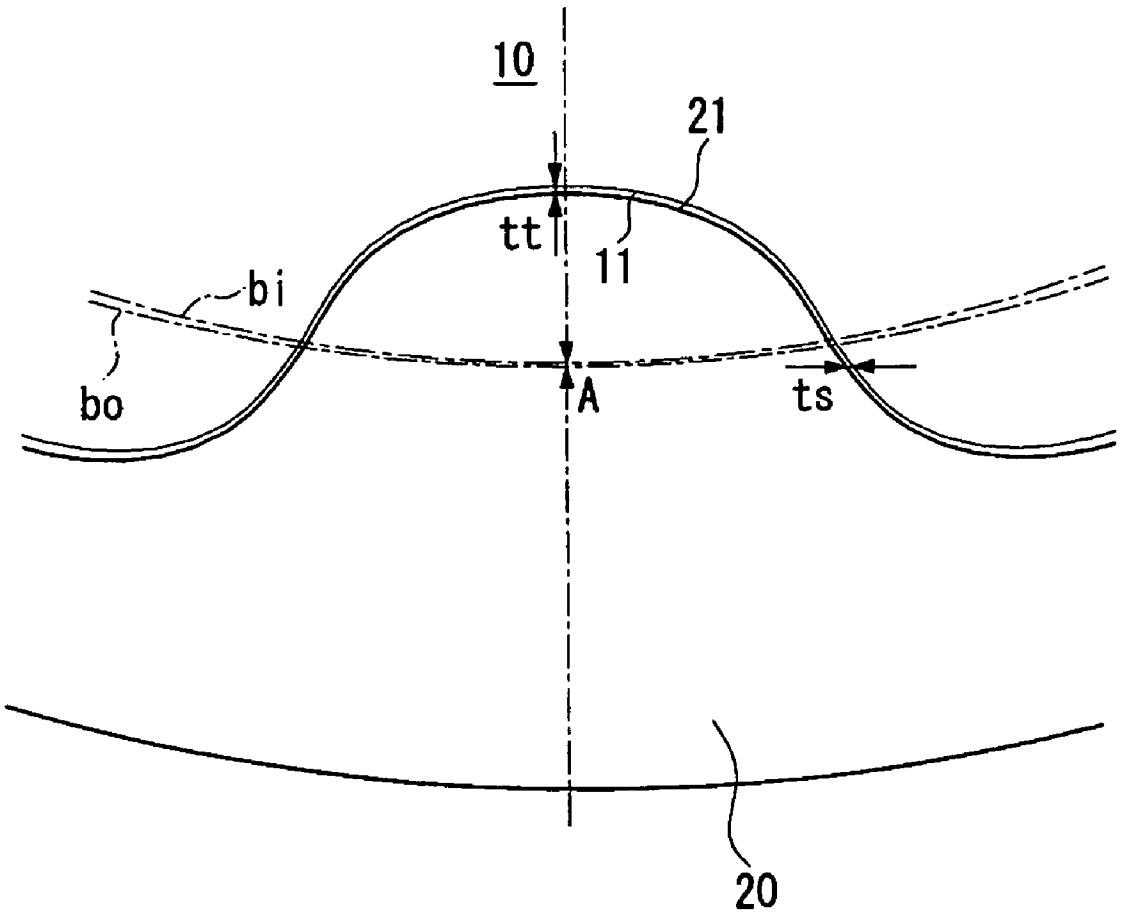
FIG. 2 is an enlarged view taken along the line II, which illustrates engaging portions of the oil pump in FIG. 1.

Furthermore, the rotational phase in which the inner and outer rotors engage with each other means a rotational phase in which a tooth tip of each of the internal teeth 21 of the outer rotor directly faces a tooth space of each of the external teeth 11 of the inner rotor 10, as shown in FIG. 2.

Here, the inner and outer rotors 10 and 20 are constructed such that the following inequality is satisfied:

$$0.005 \text{ mm} \leqq (\phi Do+\phi do)-(\phi Di+\phi di) \leqq 0.070 \text{ mm (mm: millimeters)} \quad \text{(Ic)}$$

Hereinafter, "(ϕDo+ϕdo)−(ϕDi+ϕdi)" is simply referred to as "A".

Moreover, in the present embodiment, the inner rotor 10 (ϕbi=65.00 mm; ϕDi=3.90 mm; ϕdi=2.60 mm; and n=10, where ϕbi is the diameter of the base circle bi, ϕDi is the diameter of the first circumscribed-rolling circle Di, ϕdi is the diameter of the first inscribed-rolling circle di, and n is the number of teeth) and the outer rotor 20 (ϕ=87.0 mm; ϕbo=71.599 mm; ϕDo=3.9135 mm; ϕdo=2.5955 mm, where ϕ is the external diameter of the outer rotor, ϕbo is the diameter of the base circle bo, ϕDo is the diameter of the second circumscribed-rolling circle Do, and ϕdo is the diameter of the second inscribed-rolling circle do), which satisfy the above relations, are combined with each other with the eccentric distance of e=3.25 mm, to construct an oil pump rotor assembly. Moreover, in the present embodiment, the tooth width of the inner and outer rotors (the size of teeth in the direction of the rotational axis of each rotor) is set to 10 mm. Further, the diameter ϕDi of the first circumscribed-rolling circle Di is set to 3.90 mm, the diameter ϕdi of the first inscribed-rolling circle di is set to 2.60 mm, the diameter ϕDo of the second circumscribed-rolling circle Do is set to 3.9135 mm, and the diameter ϕdo of the second inscribed rolling circle do is set to 2.5955 mm. As a result, "A" is set to 0.009 (See FIG. 2).

The casing 50 is formed with a circular-arc-shaped inlet port (not shown) along a cell C whose volume is being increasing, among cells C formed between the tooth surfaces of the inner and outer rotors 10 and 20, and the casing is also formed with a circular-arc-shaped discharge port (not shown) along a cell C whose volume is being decreasing.

While the external teeth 11 and the internal teeth 21 engage with each other, the cell C becomes the smallest in volume.

Then, when the cell moves along the inlet port, it increases in volume to draw fluid, and thereby it has the largest volume. Then, when the cell moves along the discharge port, it decreases in volume to discharge fluid.

When "A" is too small, the tip clearance and the size of backlash cannot be adequately maintained, and the noise generated when the external teeth 11 of the inner rotor and the internal teeth 21 of the outer rotor engages with each other cannot be reduced.

On the other hand, when "A" is too large, the difference between the tooth height (the size of teeth in the direction normal to the base circle) of the external teeth 11 of the inner rotor and the tooth height of the internal teeth 21 of the outer rotor, and the difference between the thickness (the size of teeth in the circumferential direction of the base circle) of the external teeth 11 and the thickness of the internal teeth 21 cannot be adequately maintained, so that a portion with no backlash may be created during the rotation of an oil pump rotor assembly. In this case, the oil pump rotor assembly cannot rotate well, so that the mechanical efficiency may be reduced and different noises may be generated due to the collision between the external teeth 11 and the internal teeth 21.

Therefore, it is preferable that "A" be set to a range that satisfies the following inequality:

$$0.005\ \text{mm} \leqq A \leqq 0.070\ \text{mm}$$

In the present embodiment, it is most preferable that "A" be set to 0.009 mm.

In the oil pump rotor assembly having the above construction, the profile of tooth tips of the outer rotor 20 is substantially equal to the profile of tooth spaces of the inner rotor 10. As a result, as shown in FIG. 2, since the side clearance ts becomes small while the tip clearance tt is surely obtained similar to the related art, the impact applied to the inner and outer rotors 10 and 20 during rotation thereof becomes small. Accordingly, even if the hydraulic pressure generated in the oil pump rotor assembly is extremely small, and the torque that drives the oil pump rotor assembly changes, the internal teeth 21 of the outer rotor can be prevented from colliding with the external teeth 11 of the inner rotor. Thus, the silence property of the oil pump rotor assembly can be surely improved. Further, since the direction of pressure when the inner and outer rotors engage with each other is perpendicular to the tooth surfaces, the torque transmission between the inner and outer rotors 10 and 20 can be performed with high efficiency without slippage, and heat and noise caused by sliding resistance can be reduced.

Figure 3:
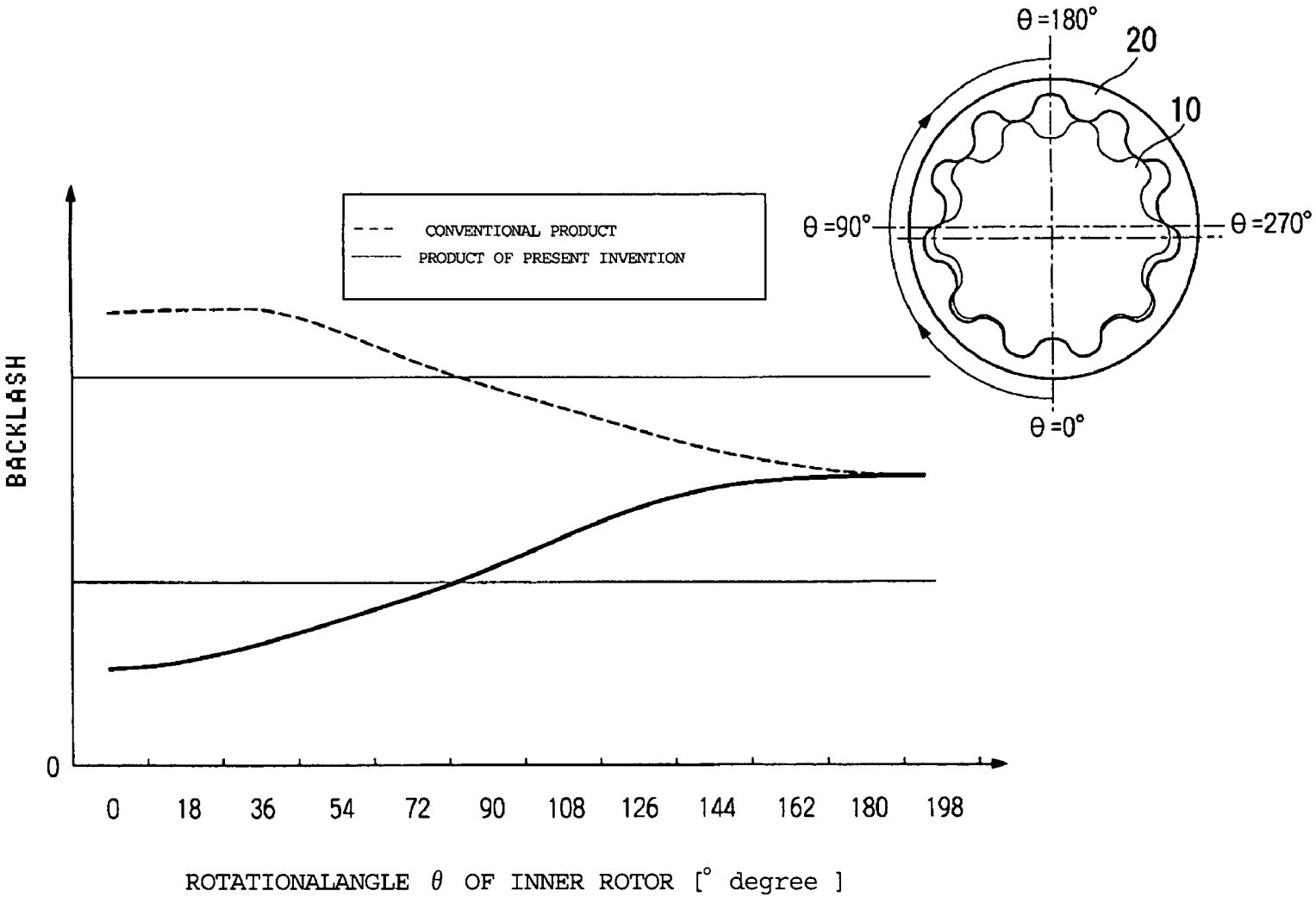
FIG. 3 is a graph that compares backlashes of the oil pump shown in FIG. 1 with backlashes of a conventional oil pump.

FIG. 3 is a graph that compares backlashes (a broken line in FIG. 3) for every rotational angle of an inner rotor in an oil pump rotor assembly of the related art with backlashes (a solid line in FIG. 3) for every rotational angle of the inner rotor in the oil pump rotor assembly according to the present invention. It can be understood from the graph that the backlash in the oil pump rotor assembly according to the present embodiment can be made smaller than that in the conventional oil pump rotor assembly in the rotational phase in which the inner and outer rotors engage with each other and while the volume of the cell C increases or decreases, and the backlash in the oil pump rotor assembly according to the present embodiment can be equal to that in the conventional oil pump rotor assembly in a rotational phase in which the volume of the cell C becomes the largest. Accordingly, it can be understood that, in the latter case, the liquid-tightness of the cell C when the volume of the cell C becomes the largest can be surely obtained, and the conveying efficiency can be maintained at the same level as the conventional oil pump rotor assembly. Moreover, only the backlashes for the rotational angle of the inner rotor ranging from 0° to 180° are shown in FIG. 3, and the other backlashes are omitted. This is because a change in backlashes for the rotational angle of the inner rotor ranging from 180° to 360° (0°) is equal to that in backlashes for the rotational angle of the inner rotor from 180° to 0°.

Figure 4:
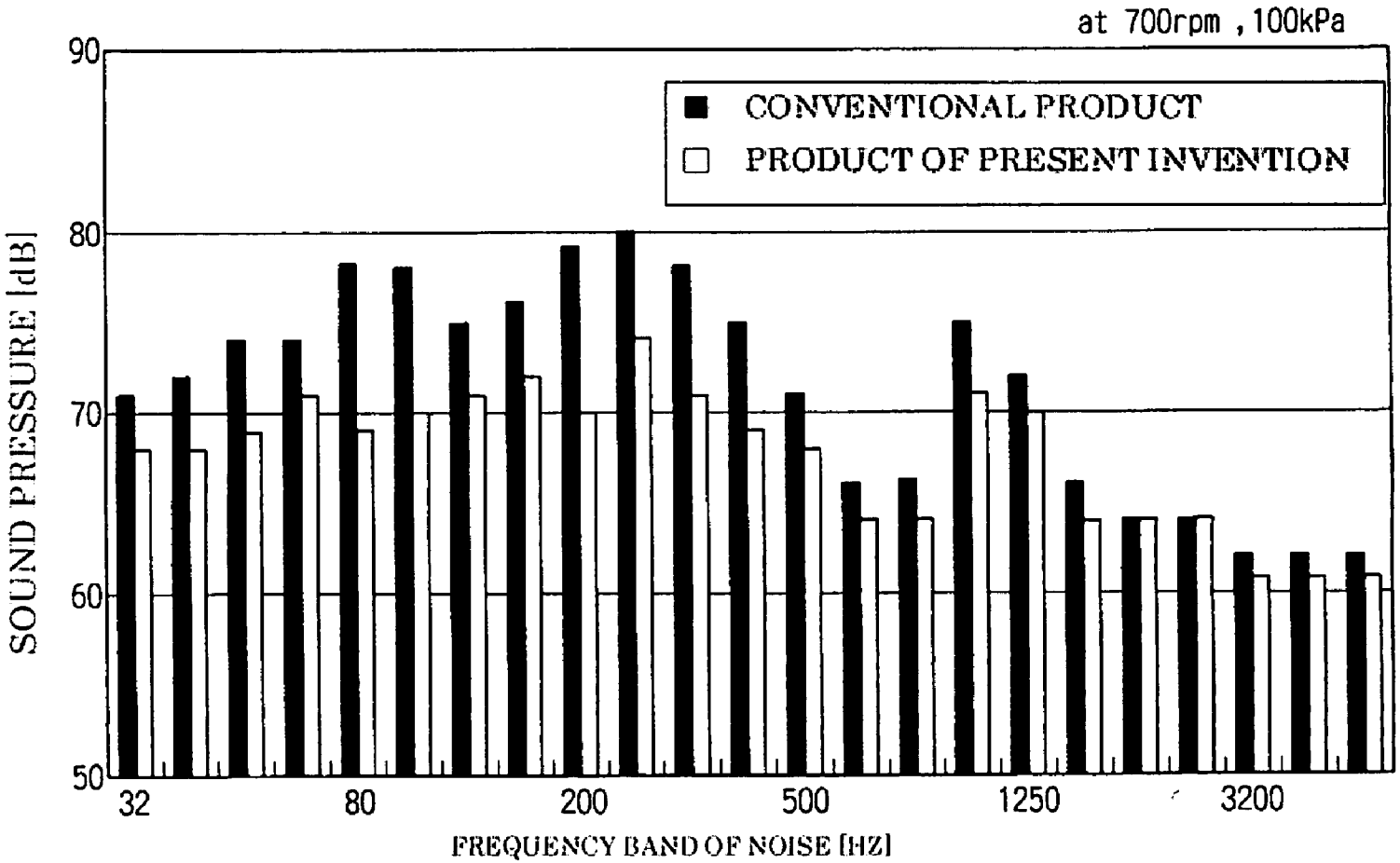
FIG. 4 is a graph that compares noise caused by the oil pump in FIG. 1 with noise caused by the conventional oil pump.

Further, FIG. 4 is a graph that compares the noise generated when the oil pump rotor assembly of the related art is used with the noise generated when the oil pump rotor assembly generated when the oil pump rotor assembly according to the present embodiment is used. It can be understood from the graph that the backlashes in the oil pump rotor assembly according to the present embodiment, as shown in FIG. 3, becomes smaller than those in the conventional oil pump rotor assembly in the rotational phase in which the inner and outer rotors engage with each other and while the volume of the cell C increases or decreases, so that noise can be decreased compared with the conventional oil pump rotor assembly and the silence property can be improved.

The technical scope of the present invention is not limited to the aforementioned embodiment, but various modifications can be made without departing from the spirit of the present invention.

INDUSTRIAL APPLICABILITY

The tooth profile of the inner rotor and the tooth profile of the outer rotor are appropriately set, and the clearance between the inner and outer rotors is appropriately set. As a result, even when the hydraulic pressure generated in the oil pump rotor assembly is extremely small and the torque that drives the oil pump rotor assembly changes, noise generation can be surely suppressed.

The invention claimed is:

1. An oil pump rotor assembly comprising:

an inner rotor formed with n external teeth where n is a natural number; and an outer rotor formed with (n+1) internal teeth for engaging with the external teeth; and a casing having a suction port for drawing fluid and a discharge port for discharging fluid, wherein the fluid is conveyed by drawing and discharging fluid by volume change of cells formed between tooth surfaces of the inner and outer rotors during relative rotation between the inner and outer rotors engaging each other, wherein each of the tooth profiles of the inner rotor is formed such that the profile of a tooth tip thereof is formed using an epicycloid curve which is generated by rolling a first circumscribed-rolling circle Di along a base circle bi without slippage, and the profile of a tooth space thereof is formed using a hypocycloid curve which is generated by rolling an inscribed-rolling circle di along the base circle bi without slippage, wherein each of the tooth profiles of the outer rotor is formed such that the profile of a tooth space thereof is formed using an epicycloid curve which is generated by rolling a second circumscribed-rolling circle Do along a base circle bo without slippage, and the profile of a tooth tip thereof is formed using a hypocycloid curve which is generated by rolling a second inscribed-rolling circle do along the base circle bo without slippage, and wherein the inner and outer rotors are constructed to satisfy the following relations:

$$\phi bi = n \cdot (\phi Di + \phi di),$$

$$\phi bo = (n+1) \cdot (\phi Do + \phi do),$$

$$\phi Di + \phi di = 2e, \text{ or } \phi Do + \phi do = 2e$$

$$\phi Do > \phi Di,$$

$$\phi di > \phi do, \text{ and}$$

$$(\phi Di + \phi di) < (\phi Do + \phi do),$$

where ϕbi is the diameter of the base circle bi of the inner rotor, ϕDi is the diameter of the first circumscribed-rolling circle Di of the inner rotor, ϕdi is the diameter of the first inscribed-rolling circle di of the inner rotor, ϕbo is the diameter of the base circle bo of the outer rotor, ϕDo is the diameter of the second circumscribed-rolling circle Do of the outer rotor, ϕdo is the diameter of the second inscribed-rolling circle do of the outer rotor, and e is the eccentric distance between the inner and outer rotors.

2. The oil pump rotor assembly according to claim 1, wherein the inner and outer rotors are constructed to satisfy the following inequality:

$$0.005 \text{ mm} \leqq (\phi Do + \phi do) - (\phi Di + \phi di) \leqq 0.070 \text{ mm (mm: millimeters)}.$$

3. An oil pump rotor assembly comprising:

an inner rotor formed with n external teeth where n is a natural number; and an outer rotor formed with (n+1) internal teeth for engaging with the external teeth; and a casing having a suction port for drawing fluid and a discharge port for discharging fluid, wherein the fluid is conveyed by drawing and discharging fluid by volume change of cells formed between tooth surfaces of the inner and outer rotors during relative rotation between the inner and outer rotors engaging each other, wherein each of the tooth profiles of the inner rotor is formed such that the profile of a tooth tip thereof is formed using an epicycloid curve which is generated by rolling a first circumscribed-rolling circle Di along a base circle bi without slippage, and the profile of a tooth space thereof is formed using a hypocycloid curve which is generated by rolling an inscribed-rolling circle di along the base circle bi without slippage, and wherein each of the tooth profiles of the outer rotor is formed such that the profile of a tooth space thereof is formed using an epicycloid curve which is generated by rolling a second circumscribed-rolling circle Do along a base circle bo without slippage, and the profile of a tooth tip thereof is formed using a hypocycloid curve which is generated by rolling a second inscribed-rolling circle do along the base circle bo without slippage, and wherein the base circle bi of the inner rotor is inscribed within the base circle bo of the outer rotor and does not contact the base circle bo.

4. The oil pump rotor assembly according to claim 3, wherein the inner and outer rotors are constructed to satisfy the following relations:

$$\phi bi = n \cdot (\phi Di + \phi di),$$

$$\phi bo = (n+1) \cdot (\phi Do + \phi do),$$

$$\phi Di + \phi di = 2e, \text{ or } \phi Do + \phi do = 2e$$

$$\phi Do > \phi Di,$$

$$\phi di > \phi do, \text{ and}$$

$$(\phi Di + \phi di) < (\phi Do + \phi do),$$

where ϕbi is the diameter of the base circle bi of the inner rotor, ϕDi is the diameter of the first circumscribed-rolling circle Di of the inner rotor, ϕdi is the diameter of the first inscribed-rolling circle di of the inner rotor, ϕbo is the diameter of the base circle bo of the outer rotor, ϕDo is the diameter of the second circumscribed-rolling circle Do of the outer rotor, ϕdo is the diameter of the second inscribed-rolling circle do of the outer rotor, and e is the eccentric distance between the inner and outer rotors.

5. The oil pump rotor assembly according to claim 4, wherein the inner and outer rotors are constructed to satisfy the following inequality:

$$0.005 \text{ mm} \leqq (\phi Do + \phi do) - (\phi Di + \phi di) \leqq 0.070 \text{ mm (mm: millimeters)}.$$

6. An oil pump rotor assembly comprising:

an inner rotor with n external teeth where n is a natural number; and an outer rotor with (n+1) internal teeth for engaging with the external teeth; and a casing having a suction port for drawing fluid and a discharge port for discharging fluid, wherein the profile of a tooth tip of each tooth of the inner rotor conforms to an epicycloid curve which is generated by rolling a first circumscribed-rolling circle along an inner base circle of the inner rotor, and the profile of a tooth space of the inner rotor is formed using a hypocycloid curve which is generated by rolling an inscribed-rolling circle along the inner base circle, wherein the profile of a tooth space of the outer rotor conforms to an epicycloid curve which is generated by rolling a second circumscribed-rolling circle along an outer base circle, and the profile of a tooth tip of each tooth of the outer rotor is formed using a hypocycloid curve which is generated by rolling a second inscribed-rolling circle along the outer base circle, and wherein the inner base circle is inscribed within the outer base circle and does not contact the outer base circle.

7. The oil pump rotor assembly according to claim 6, wherein the inner and outer rotors are constructed to satisfy the following relations:

$$\phi bi = n \cdot (\phi Di + \phi di),$$

$$\phi bo = (n+1) \cdot (\phi Do + \phi do),$$

$$\phi Di + \phi di = 2e, \text{ or } \phi Do + \phi do = 2e$$

$$\phi Do > \phi Di,$$

$$\phi di > \phi do, \text{ and}$$

$$(\phi Di + \phi di) < (\phi Do + \phi do),$$

where ϕbi is the diameter of the inner base circle, bi, of the inner rotor; ϕDi is the diameter of the first circumscribed-rolling circle, Di, of the inner rotor; ϕdi is the diameter of the first inscribed-rolling circle, di, of the inner rotor; ϕbo is the diameter of the outer base circle, bo, of the outer rotor; ϕDo is the diameter of the second circumscribed-rolling circle, Do, of the outer rotor; ϕdo is the diameter of the second inscribed-rolling circle, do, of the outer rotor; and e is the eccentric distance between the inner and outer rotors.

8. The oil pump rotor assembly according to claim 7, wherein the inner and outer rotors are constructed to satisfy the following inequality:

$$0.005 \text{ mm} \leqq (\phi Do + \phi do) - (\phi Di + \phi di) \leqq 0.070 \text{ mm (mm: millimeters)}.$$

* * * * *

UNITED STATES PATENT AND TRADEMARK OFFICE

CERTIFICATE OF CORRECTION

PATENT NO. : 7,588,429 B2
APPLICATION NO. : 10/556744
DATED : September 15, 2009
INVENTOR(S) : Katsuaki Hosono It is certified that error appears in the above-identified patent and that said Letters Patent is hereby corrected as shown below:

On the Title Page, Item (73) under Assignee's address, please delete "Nigata" and insert -- Niigata -- therefor.

Signed and Sealed this

Ninth Day of February, 2010

David J. Kappos

David J. Kappos
*Director of the United States Patent and Trademark Office*